US006229425B1

(12) United States Patent
Kobayashi

(10) Patent No.: US 6,229,425 B1
(45) Date of Patent: May 8, 2001

(54) COMMON MODE INDUCTOR

(75) Inventor: Hirofumi Kobayashi, Fukui-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/324,065

(22) Filed: Jun. 1, 1999

(30) Foreign Application Priority Data

Jul. 10, 1998 (JP) ..... 10-196191

(51) Int. Cl.[7] ..... H01F 5/00
(52) U.S. Cl. ..... 336/200; 336/83
(58) Field of Search ..... 336/200, 223, 336/232, 83; 257/531

(56) References Cited

U.S. PATENT DOCUMENTS 5,278,526 * 1/1994 Ikeda ..... 333/185
5,578,981 * 11/1996 Tokuda ..... 336/171
5,583,470 * 12/1996 Okubo ..... 333/185
6,023,214 * 2/2000 Ohta et al. ..... 336/84 R

FOREIGN PATENT DOCUMENTS 8-138938 * 5/1996 (JP) .

* cited by examiner

*Primary Examiner*—Lincoln Donovan
*Assistant Examiner*—Tuyen T. Nguyen
(74) *Attorney, Agent, or Firm*—Keating & Bennett, LLP

(57) ABSTRACT

A common mode inductor has a very small size and high reliability, and is constructed such that it can be inexpensively manufactured, and, when inserted to an electronic circuit, the dc resistance of the coils of the in-phase inductor has little or no effect on the electronic circuit. The common mode inductor has a laminated structure including at least four coils each having coil conductors and insulating sheets. The first and second coils are electrically connected in series so as to define a single coil. Consequently, the dc resistance value of this single coil is less than the dc resistance values of the third and fourth coils. The third and fourth coils are located between the first and second coils, in a stacking direction of the insulating sheets.

12 Claims, 3 Drawing Sheets

COMMON MODE INDUCTOR

BACKGROUND OF THE INVENTION

1. Field of the Invention

The present invention relates to a common mode inductor, and more particularly, to a common mode inductor which is constructed to be used as a noise filter, for example.

2. Description of the Related Art

A conventional common mode inductor of this type is, for instance, a multilayer common mode inductor having an electrical equivalent circuit arrangement shown in FIG. 4. This common mode inductor includes a coil La which is connected between an input electrode 1*a* and an output electrode 1*b*, a coil Lb which is connected between an input electrode 2*a* and an output electrode 2*b*, and a coil Lc which is connected between an input electrode 3*a* and an output electrode 3*b*. The coils La, Lb and Lc are electromagnetically coupled together and are arranged to prevent passage of common mode noise in the same phase.

In this type of common mode inductor, the lower the dc resistance values of the three coils La–Lc, the better the signal propagation characteristics of the inductor. Therefore, in the conventional common mode inductor, a material having low resistivity is used to form the coil conductors which define the coils La–Lc, and the dc resistance values of all the coils La–Lc are lowered by increasing the thickness of the coil conductors.

However, the importance of the dc resistance values of the three coils La–Lc is sometimes different, depending on the circuit in which the common mode inductor is used. For instance, consider a case where the common mode inductor is used as a filter for eliminating noise in an audio circuit of an audio device, such as a stereo. An audio circuit is a three-wire circuit which includes left and right signal lines and a common ground line. Normally, the coils La–Lc of the common mode inductor are arranged in a parallel configuration, and the coils La and Lc on each end are respectively connected to the left and right signal lines of the audio circuit. The coil Lb located in the center of the three coils La–Lc is connected to the common ground line of the audio circuit. The purpose of this type of connection is to ensure that the electromagnetic coupling between the left signal line and the ground line is substantially equal to the electromagnetic coupling between the right signal line and the ground line.

When the in-phase inductor is connected to the audio circuit in this manner, a phenomenon known as crosstalk may occur, in which signals leak between the left and right signal lines. Crosstalk is mainly caused when the center coil Lb, which is connected to the ground line, has a high dc resistance value, which acts as what is referred to as a common-mode impedance of the left and right sides of the audio circuit. On the other hand, the dc resistance values of the coil La and the coil Lc have almost no effect on generating crosstalk. In other words, when a common mode inductor is used as a filter for eliminating noise in an audio circuit, it is only necessary to lower the dc resistance value of the centrally located coil Lb which is connected to the ground line of the audio circuit.

Therefore, when an expensive material having low resistivity is used to reduce the dc resistance values of all the coils La–Lc, the manufacturing cost increases and the more expensive, low resistivity material is also wasted. In addition, increasing the thickness of the coil conductors is likely to cause separation of layers (delamination) when the laminated body is fired.

SUMMARY OF THE INVENTION

In order to overcome the problems described above, preferred embodiments of the present invention provide a common mode inductor which has a very small size and high reliability, is constructed to be inexpensively manufactured, and, when connected to an electronic circuit, the dc resistance of the coil of the common mode inductor has little or no effect on the electronic circuit.

According to one preferred embodiment of the present invention, a common mode inductor includes:

(a) a laminated body including a plurality of insulating layers and a plurality of coil conductors stacked on each other in a stacking direction;

(b) at least three coils defined by electrically connecting the coil conductors, the coils being magnetically coupled together;

(c) at least three pairs of external input and output electrodes, provided on a surface of the laminated body and electrically connected to the coils; wherein (d) the at least three coils are arranged in the stacking direction of the laminated body, and one of the coils includes a first coil portion and a second coil portion which are located spaced apart from each other, and the remaining coils are disposed between the first coil portion and the second coil portion in the stacking direction of the laminated body, a dc resistance value of the coil having the first coil portion and the second coil portion is smaller than dc resistance values of the remaining coils.

With the above-described unique arrangement and construction, it is no longer necessary to reduce the dc resistance values of all of the coils, and the dc resistance value of only one specific coil can be reduced. Then, when the common mode inductor is incorporated into an electronic circuit such as an audio circuit, the specific coil having relatively lower dc resistance value can be connected to the line which requires the lowest dc resistance value, thereby reducing the effect of the dc resistance of the coils on the electronic circuit caused by the connection of the common mode inductor to the electronic circuit, and making it possible to achieve an electronic circuit having desired performance characteristics.

Furthermore, according to preferred embodiments of the common mode inductor of the present invention, the pair of external input and output electrodes which are electrically connected to the coil having the first coil portion and the second coil portion are provided in the approximate center of the laminated body, and multiple pairs of external input and output electrodes which are electrically connected to the remaining coils, are provided in the laminated body on either side of the above-mentioned pair of external input and output electrodes.

As a result, the in-phase inductor has a structure which can be easily incorporated into an audio circuit. That is, the ground line which is located in the approximate center of the three-line audio circuit, is electrically connected to the external input and output electrodes of the coil having the relatively lower dc resistance value, which is located in the approximate center of the in-phase inductor. On the other hand, the signal lines on the left and right sides of the audio circuit are electrically connected to the coils having relatively higher dc resistance values, which are provided on the left and right ends of the common mode inductor, without intersecting the ground line.

The above and further objects, characteristics and advantages of the present invention will more fully appear from the following detailed description of preferred embodiments taken in conjunction with the accompanying drawings.

DETAILED DESCRIPTION OF PREFERRED EMBODIMENTS

Described below are preferred embodiments of the present invention with reference to the accompanying drawings. Each of the following preferred embodiments describes an example in which the common mode inductor is used as a noise filter.

Figure 1:
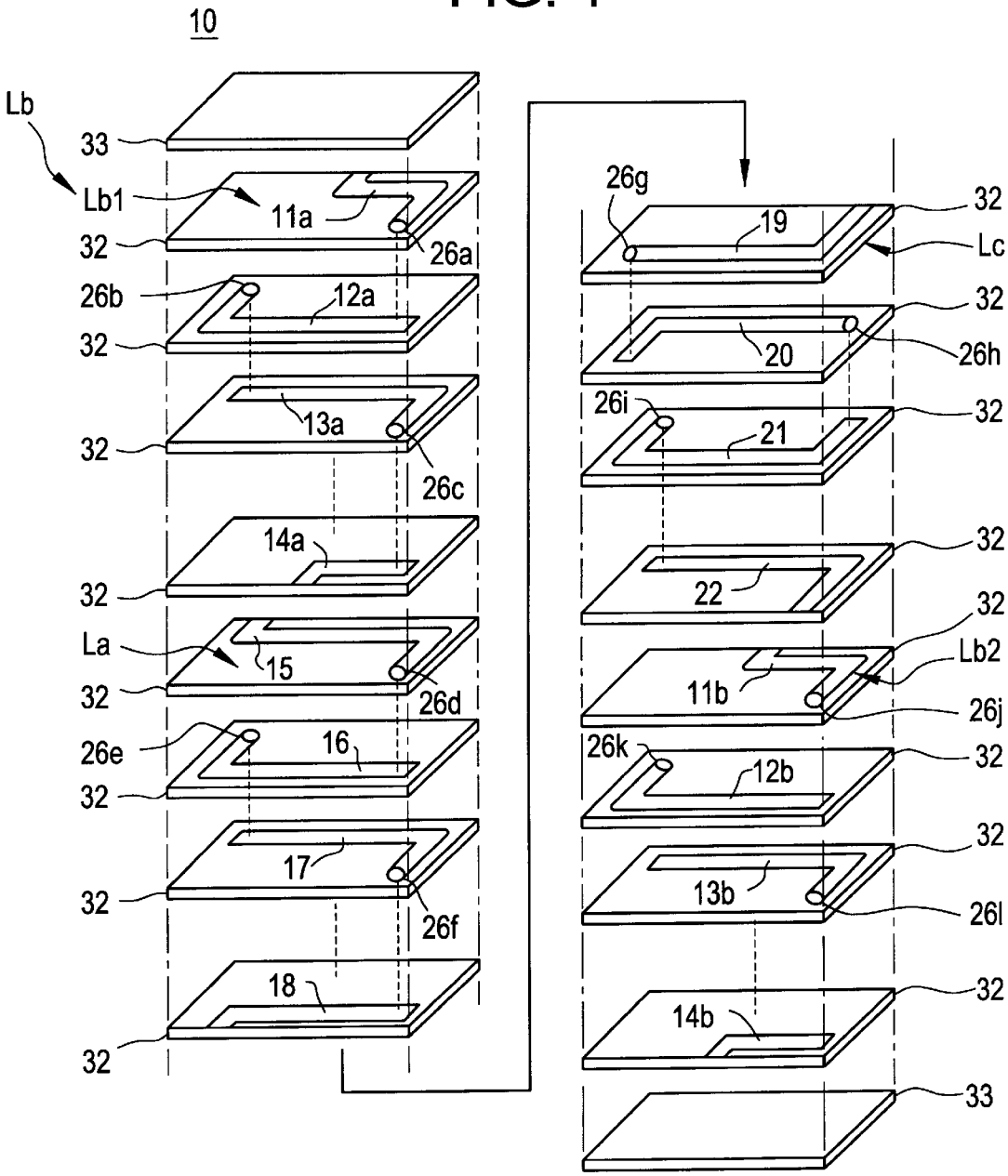
FIG. 1 is an exploded perspective view of a first preferred embodiment of a common mode inductor of the present invention.

As shown in FIG. 1, an in-phase inductor 10 has a laminated body including coil conductors 11*a*–22 provided on surfaces of stacked insulating sheets 32 and cover sheets 33 which are provided on the top and bottom of the stack of insulating sheets 32. The coil conductors 11*a*-22 are formed on the surfaces of the insulating sheets 32 via a suitable method such as printing. A material such as Ag, Ag—Pd, Cu or Ni is preferably used to form the coil conductors 11*a*–22. A magnetic material such as ferrite, and a dielectric material and an insulating material, such as ceramic, are preferably used to form the sheets 32 and 33.

The coil conductors 11*a*–14*a* are electrically connected in series through via holes 26*a*–26*c* formed in the insulating sheets 32, thereby defining a helical coil Lb1. One end of the coil Lb1 (that is, the extension part of the coil conductor 11*a*) is exposed at the approximate center of the rear side of the insulating sheet 32, and the other end (that is, the extension part of the coil conductor 14*a*) is exposed at the approximate center of the front side of the insulating sheet 32.

The coil conductors 11*b*–14*b* are electrically connected in series through via holes 26*j*–26*l* formed in the insulating sheets 32, thereby defining a helical coil Lb2. One end of the coil Lb2 (that is, the extension part of the coil conductor 11*b*) is exposed at the approximate center of the rear side of the insulating sheet 32, and the other end (that is, the extension part of the coil conductor 14*b*) is exposed at the approximate center of the front side of the insulating sheet 32. As will be explained below, the two coils Lb1 and Lb2 are electrically connected in series defining a single coil Lb.

Furthermore, the coil conductors 15–18 are electrically connected in series through via holes 26*d*–26*f* formed in the insulating sheets 32, thereby defining a helical coil La. One end of the coil La (that is, the extension part of the coil conductor 15) is exposed at the left portion of the rear side of the insulating sheet 32, and the other end (that is, the extension part of the coil conductor 18) is exposed at the left portion of the front side of the insulating sheet 32.

The coils 19–22 are electrically connected in series though via holes 26*g*–26*i* formed in the insulating sheets 32, thereby defining a helical coil Lc. One end of the coil Lc (that is, the extension part of the coil conductor 19) is exposed at the right portion of the rear side of the insulating sheet 32, and the other end (that is, the extension part of the coil conductor 22) is exposed at the right portion of the front side of the insulating sheet 32.

Figure 2:
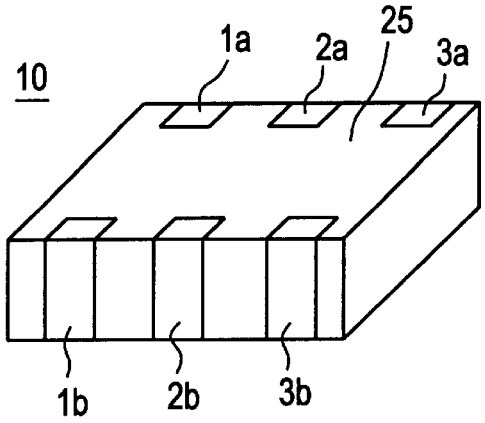
FIG. 2 is a perspective view of the outside of the common mode inductor shown in FIG. 1.

The insulating sheets 32 and covering sheets 33 are stacked up and then fired together, thereby defining a laminated body 25 as shown in FIG. 2. Input electrodes 1*a*, 2*a* and 3*a* are located approximately in the left, center and right sides of the rear surface of the laminated body 25. Output electrodes 1*b*, 2*b* and 3*b* are located approximately in the left, center and right sides of the front surface of the laminated body 25. The input electrode 1*a* and the output electrode 1*b* are electrically connected to both ends of the coil La, that is, to the coil conductor 15 and the coil conductor 18, respectively. The input electrode 2*a* and the output electrode 2*b* are electrically connected to both ends of the coils Lb1 and Lb2, that is, to the coil conductors 11*a* and 11*b*, and the coil conductors 14*a* and 14*b*, respectively. In other words, the two coils Lb1 and Lb2 are electrically connected in series between the input electrode 2*a* and the output electrode 2*b*. As a consequence, the two coils Lb1 and Lb2 define a single coil Lb. The input electrode 3*a* and the output electrode 3*b* are electrically connected to both ends of the coil Lc, that is, to the coil conductor 19 and the coil conductor 22, respectively. The input and output electrodes 1*a*–3*b* are formed by applying a dielectric paste such as Ag, Ag—Pd and Ni, and then burning or dry plating.

Figure 3:
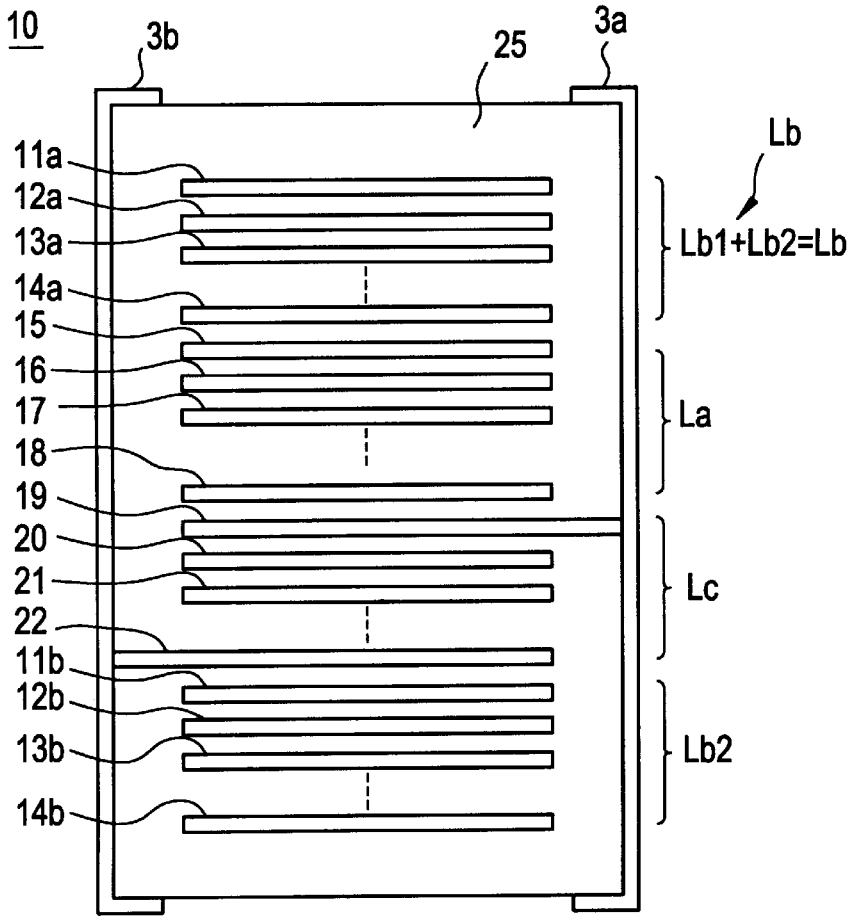
FIG. 3 is a schematic view of a coil conductor of the common mode inductor shown in FIG. 2.
Figure 4:
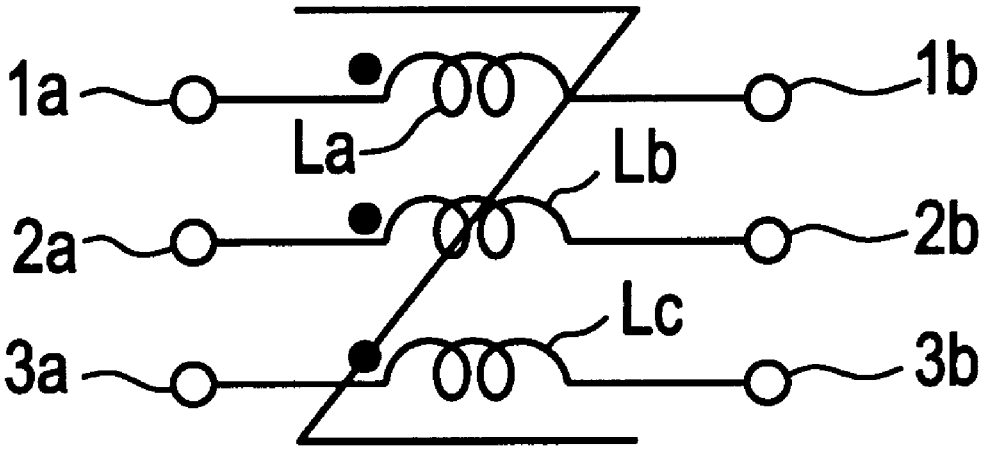
FIG. 4 PRIOR ART
FIG. 4 is an electrical equivalent circuit diagram of a common mode inductor.

As shown in FIG. 3, in the in-phase inductor 10 having the unique construction described above, the coils La, Lb1, Lb2 and Lc are arranged substantially parallel to the stacking direction of the laminated body 25. Particularly, in the present preferred embodiment, the axes of the coils La, Lb1, Lb2 and Lc are substantially parallel to the stacking direction, and in addition, the level of electromagnetic coupling between the coils La, Lb1, Lb2 and Lc is increased by aligning the axes of the coils La, Lb1, Lb2 and Lc. The electrical equivalent circuit of the in-phase inductor 10 is preferably the same as the equivalent circuit shown in FIG. 4. Since the coil Lb includes the two coils Lb1 and Lb2 defined by the coil conductors 11*a*–14*a* and the coil conductors 11*b*–14*b*, the dc resistance value of the coil Lb is approximately half of the dc resistance value of the other coils La and Lc, even though the coil conductors 11*a*–14*a* and 11*b*–14*b* have the same thickness as the coil conductors 15–18 and 19–22.

Therefore, when the common mode inductor 10 is used as a filter for eliminating noise in an audio circuit of a stereo or the like, the coil Lb which has a relatively lower dc resistance value is connected to the ground line of the audio circuit, to which the lowest dc resistance value is connected. Then, the coils La and Lc, which have relatively larger dc resistance values, are connected to the left and right signal lines of the audio circuit, which are substantially unaffected by the dc resistance values of coils connected thereto. Consequently, the low dc resistance value of the coil Lb acts as joint impedance of the left and right sides of the audio circuit, thereby significantly reducing crosstalk between the left and right audio circuits.

The ground line which is provided in the approximate center of the three-line audio circuit, is electrically connected to the input and output electrodes 2*a* and 2*b* of the relatively lower dc resistance value coil Lb, which is located in the approximate center of the common mode inductor 10. On the other hand, the signal lines of the left and right audio circuits are electrically connected to input and output electrodes 1*a*, 1*b*, 3*a* and 3*b* of the coils La and Lc of relatively higher dc resistance values, which are located on the left and right ends of the common mode inductor 10. Thus, since the input and output electrodes 2*a* and 2*b* of the relatively lower dc resistance value coil Lb are provided in the approximate center, the ground line and signal lines of the audio circuit do not intersect, whereby the common mode inductor 10 can be easily connected to the audio circuit.

In consideration of noise received from the installation environment, the coils connected to the signal lines of the audio circuit should preferably be provided in the approximate center of the stack in the stacking direction. Therefore, the coils La and Lc are provided between the two coils Lb1 and Lb2 which define the coil Lb, in the direction in which the components of the laminated body 25 are stacked. Furthermore, since it is not necessary to increase the thickness of the coil conductors 11*a*–22, it is possible to reduce breakage and delamination of the sheets 32 and 33 during firing and other processing of the laminated body 25.

The present invention is not limited to the above-described preferred embodiments, and various modifications can be made thereto within the scope of the present invention.

For instance, the above preferred embodiments describes a common mode inductor having three coils, namely a trifilar structure, but the present invention can also be applied to a common mode inductor having four or more coils.

Furthermore, the manufacture of a multilayer common mode inductor is not restricted to stacking insulating sheets having coil conductors provided on their surfaces, and then firing the stacked elements together. Insulated sheets which have been fired beforehand may be used.

Alternatively, the laminated common mode inductor may be made according to the following process. That is, an insulating layer is formed on a paste-like insulating sheet via printing or the like, and then a paste-like conductive material is applied to the surface of the insulating layer, thereby forming a coil conductor. Next, a paste-like insulating material is pasted over the coil conductor, whereby the coil conductor is contained within an insulating layer. While sequentially repeating these steps, the coil conductor is electrically connected in the required places, achieving a common mode inductor of laminated structure.

As is clear from the above explanation, according to the present invention, it is no longer necessary to reduce the dc resistance values of all of the coils in a common mode inductor, making it possible to reduce the dc resistance value of a specific coil. Then, when the common mode inductor is inserted into an electronic circuit such as an audio circuit, the specific coil having the relatively lower dc resistance value can be connected to the line which requires the lowest dc resistance value, thereby reducing the effect of the dc resistance of the coils on the electronic circuit, caused by the insertion of the common mode inductor, and making it possible to achieve an electronic circuit having desired performance characteristics. For instance, in the case of an audio circuit, by connecting the coil which has a relatively lower dc resistance value to the ground line, the low dc resistance value acts as a joint impedance, thereby significantly reducing crosstalk in the audio circuit.

Furthermore, by locating a pair of external input and output electrodes, which are electrically connected to the relatively lower dc resistance value coil which includes a first coil portion and a second coil portion, in the approximate center of the laminated body, and providing multiple external input/output electrodes, which are electrically connected to the remaining coils, between the pair of external input/output electrodes, the ground line in the approximate center of the audio circuit and the signal lines on the left and right sides of the audio circuit do not intersect, whereby the audio circuit can be easily connected to the common mode inductor. Moreover, it is not necessary to increase the thickness of the coil conductors, and consequently, it is possible to reduce breakage and delamination of the insulating sheets during firing and other processing of the laminated body.

While the invention has been particularly shown and described with reference to preferred embodiments thereof, it will be understood by those skilled in the art that the forgoing and other changes in form and details may be made therein without departing from the spirit of the invention.

What is claimed is:

1. A common mode inductor, comprising:

a laminated body including a plurality of insulating layers and a plurality of coil conductors stacked on each other in a stacking direction such that the coil conductors are spaced from each other in the stacking direction with the plurality of insulating layers disposed between the coil conductors;

at least three coils defined by the coil conductors being electrically connected to each other, the at least three coils being magnetically coupled together;

at least three pairs of external input and output electrodes, provided on a surface of the laminated body and electrically connected to the at least three coils; wherein the at least three coils are arranged such that the respective coil conductors which are electrically connected to each other define the respective at least three coils and are spaced from each other in the stacking direction of the laminated body, and one of the at least three coils is a ground line coil arranged to be connected to a ground line, said ground line coil includes a first coil portion and a second coil portion which are spaced apart from each other in the stacking direction of the laminated body and are electrically connected in parallel, and the remaining ones of the at least three coils are signal line coils arranged to be connected to signal lines, said signal line coils are disposed between the first coil portion and the second coil portion in the stacking direction of the laminated body, said ground line coil is arranged outside of said signal line coils, a dc resistance value of said ground line coil having the first coil portion and the second coil portion is smaller than dc resistance values of said signal line coils.

2. The common mode inductor according to claim 1, wherein a first of said at least three pairs of said external input and output electrodes which are electrically connected to said ground line coil having the first coil portion and the second coil portion, are located in the approximate center of said laminated body, and remaining ones of said at least three pairs of said external input and output electrodes which are electrically connected to said said signal line coils, are located in said laminated body on either side of said first of said pairs of said external input and output electrodes.

3. The common mode inductor according to claim 1, wherein the first coil portion of said one of the at least three coils is located at a top portion of the laminated body and the second coil portion of said one of the at least three coils is located at a bottom portion of the laminated body.

4. The common mode inductor according to claim 1, wherein the dc resistance value of said one of the at least three coils having the first coil portion and the second coil portion is approximately half of the dc resistance value of each of the remaining ones of the at least three coils.

5. The common mode inductor according to claim 4, wherein each of the coil conductors have approximately the same thickness.

6. The common mode inductor according to claim 1, wherein the coil conductors are made of at least one of Ag, Ag—Pd, Cu and Ni.

7. The common mode inductor according to claim 1, wherein the pluarlity of insulating layers are made of at least one of a magnetic material and a dielectric material.

8. The common mode inductor according to claim 1, wherein the first coil portion of said one of the at least three coils is connected to the second coil portion of said one of the at least three coils via at least one of the external input and output electrodes disposed on an outer surface of the laminated block.

9. The common mode inductor according to claim 1, wherein the first coil portion of said one of the at least three coils is connected to the second coil portion of said one of the at least three coils are electrically connected in series.

10. The common mode inductor according to claim 1, wherein each of the first coil portion and the second coil portion of said one of the at least three coils is a separate coil and the first coil portion and the second coil portion are electrically connected to define a single one of the at least three coils.

11. The common mode inductor according to claim 1, wherein said signal line coils and said ground line coil define a trifilar structure.

12. The common mode inductor according to claim 1, wherein the first coil portion and the second coil portion of said ground line coil are defined by coil conductors having substantially the same shape.

* * * * *